US008656580B2

(12) United States Patent
Steiner et al.

(10) Patent No.: US 8,656,580 B2
(45) Date of Patent: Feb. 25, 2014

(54) COMPRESSION CONNECTOR TOOL

(75) Inventors: Richard A. Steiner, East Haddam, CT (US); Charles Gargano, Guilford, CT (US)

(73) Assignee: Rostra Tool Company, Branford, CT (US)

( * ) Notice: Subject to any disclaimer, the term of this patent is extended or adjusted under 35 U.S.C. 154(b) by 0 days.

(21) Appl. No.: 13/541,020

(22) Filed: Jul. 3, 2012

(65) Prior Publication Data

US 2014/0007426 A1 Jan. 9, 2014

(51) Int. Cl.
*H01R 43/042* (2006.01)

(52) U.S. Cl.
USPC ..... 29/751

(58) Field of Classification Search
CPC ..... H01R 43/0425
USPC ..... 29/751
See application file for complete search history.

(56) References Cited

U.S. PATENT DOCUMENTS

| | | | | |
|---|---|---|---|---|
| 7,152,309 | B2 | 12/2006 | Liao | |
| 7,596,860 | B2 * | 10/2009 | Sutter et al. | 29/751 |
| 2009/0260227 | A1 * | 10/2009 | Montena | 29/751 |

* cited by examiner

*Primary Examiner* — Livius R Cazan
(74) *Attorney, Agent, or Firm* — Cantor Colburn LLP

(57) ABSTRACT

A tool for coupling a connector to a wire is provided. The tool includes a first handle coupled to move a connecting head from a first position to a second position. A second handle is operably coupled to the first handle. A die block is rotationally coupled to the second handle and has a first connecting section and a second connecting section. A pair of support arms is pivotally coupled to the die block adjacent the first connecting section. The pair of support arms each having a body with an opening. The openings cooperate to define a circular opening when in the closed position. The circular opening is sized to provide 360 degrees of support to an end of the connector when the connecting head is in the second position. A biasing member is coupled to the pair of support arms to bias the support arms towards the closed position.

13 Claims, 5 Drawing Sheets

B – B

COMPRESSION CONNECTOR TOOL

BACKGROUND OF THE INVENTION

The subject matter disclosed herein relates to a tool for coupling a compression connector to a wire, and particularly to a tool that reduces the risk of connector deformation during the coupling process.

Wires, such as coaxial wires for example, have connectors on their ends which allow the wire to be removably coupled to a device or another wire. Connectors are divided into several classes based on their function as well as their intended application, such as for sound channels, for broadband networks and for cable television sets for example. Connectors in each of these applications may have different construction or diameters.

Tools of this type typically have two handles with a die block connected thereto. A corresponding connecting-head aligns a connector and wire with the die block. When the handles are pressed together, the connecting-head moves towards the die block contacting the connector. This pressing action couples the connector to the wire. Unfortunately, some types of connectors are more susceptible to being deformed during the pressing action. When the connector is deformed, the operator may have to remove the end of the wire and couple a new connector, resulting lost time and increased costs.

Accordingly, while existing connector crimping tools are suitable for their intended purposes the need for improvement remains, particularly in providing a tool that couples a wire to a connector without deforming the connector body.

BRIEF DESCRIPTION OF THE INVENTION

According to one aspect of the invention, a tool is provided for coupling a connector to a wire. The tool includes a first handle and a connecting head operably coupled to the first handle. The connecting head being movable from a first position to a second position in response to the movement of the first handle. A second handle is operably coupled to the first handle. A die block is rotationally coupled to the second handle, the die block having a first connecting section and a second connecting section. A pair of support arms is pivotally coupled to the die block adjacent the first connecting section, the pair of support arms each having a body with an opening. The pair of support arms are movable between an open and a closed position, the openings cooperating with each other to define a substantially circular opening when in the closed position. The circular opening being sized to provide substantially 360 degrees of support to an end of the connector when the connecting head is in the second position. A biasing member is coupled to the pair of support arms to bias the support arms towards the closed position.

According to another aspect of the invention, a method of coupling a connector to a wire is provided. The method includes inserting a connector onto a wire. A connecting section of a die block is aligned with a connecting-head on a tool. A pair of support arms is rotated from a first position to a second position. The connector is inserted into a tool with the connector engaging the connecting-head and the wire disposed in a slot the die block. The pair of support arms are biased towards a closed position. The pair of support arms are released. The wire is captured in a circular opening defined by the pair of support arms, wherein the connector is positioned between the support arms and the connecting-head.

According to yet another aspect of the invention, a tool is provided for coupling a connector to a wire, the connector having a body. The tool includes a first handle. A mechanism is operably coupled to the first handle and has a connecting head, the mechanism moving the connecting head from a first position to a second position in response to the movement of the first handle. A second handle is operably coupled to the first handle. A die block is operably coupled to the second handle, The die block having a first connecting section and a second connecting section. A fastener is configured to rotationally couple the die block to the second handle, the fastener having an annular slot. A pair of support arms is pivotally coupled to the die block adjacent the annular slot, the pair of support arms each having a body with an opening, wherein the pair of support arms are movable between an open and a closed position, the openings cooperating with each other to define a substantially circular opening when in the closed position. A biasing member is disposed at least partially within the annular slot, the biasing member being coupled to the pair of support arms to bias the support arms towards the closed position.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
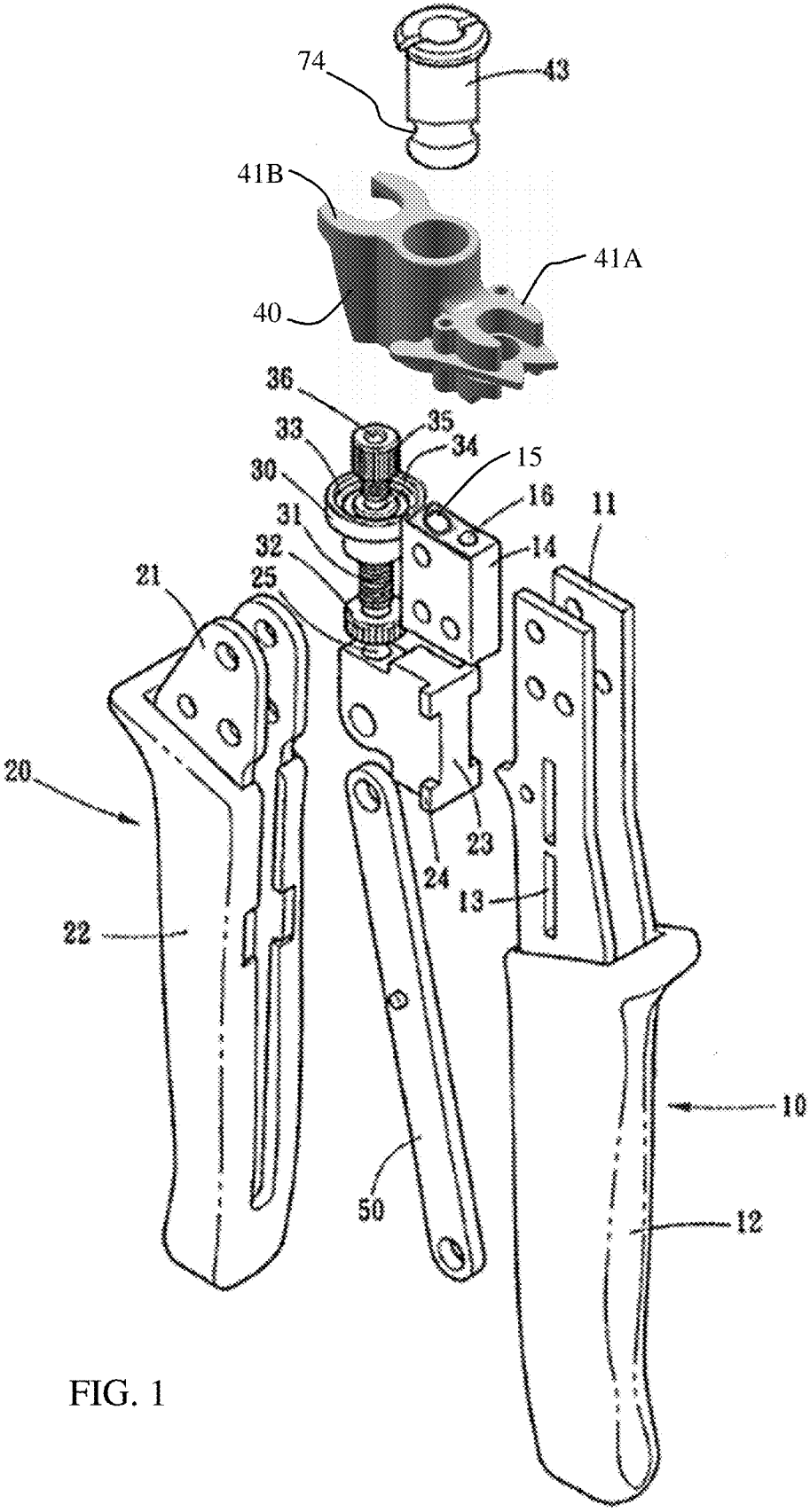
FIG. 1 is a perspective view of a connector tool in accordance with an embodiment of the invention.
Figure 2:
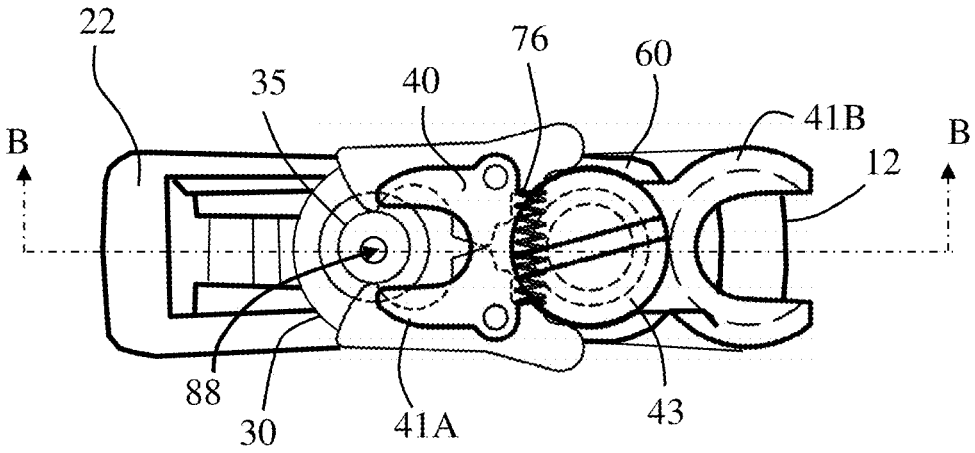
FIG. 2 is a top view of the tool of FIG. 1 in a first position.

The detailed description explains embodiments of the invention, together with advantages and features, by way of example with reference to the drawings.

DETAILED DESCRIPTION OF THE INVENTION

A tool 8 for coupling multiple sizes of compression connectors to wire is shown in FIGS. 1-4. The tool 8 includes a first handle 10 and a second handle 20. A connecting-head 30 is coupled to the second handle 20. A die block 40 is disposed on an opposite end adjacent the connecting-head 30.

The first handle 10 has two frame members 11 on its upper end, and has a holding sleeve 12 on its lower end. The frame members 11 are provided each with two slide slots 13. In one embodiment, the slide slots 13 area positioned in a co-linear arrangement. A fixing block 14 is arranged between the frame members 11 and is coupled with a fastener, such as a bolt for example. In one embodiment, the fixing block 14 has a screw-connecting portion 15 and a detent 16. As will be discussed in more detail below, the detent 16 cooperates with a feature on the die block 40 to selectively retain the die block 40 in a desired position.

The second handle 20 has two frame members 21 on its upper end, and a gripping member 22 on its lower end. A linkage portion 23 is arranged between the frame members 21 with a slide block 24 in alignment with the slide slots 13. In this manner, when the first handle 10 is closed against to the second handle 20, the linkage portion 23 is slid towards the die block 40 by the movement of slide block 24 within the slide slots 13.

The linkage portion 23 further includes a screw-connecting hole 25 for mounting of the connecting-head 30. A link 50 is coupled between the first handle 10 with the second handle 20.

The connecting-head 30 includes a thread portion 31 on an end positioned opposite the screw-connecting hole 25 of the linkage portion 23. The threaded position 31 engages the hole 25 to movably couple the head 30 to the linkage portion 23. A fastener 32 is arranged on the threaded portion 31 to allow the height adjustment of the head 30 relative to the linkage portion 23.

The connecting-head 30 has an upper end with a press-connecting recess 33 that is sized and configured to receive connectors of various sizes. The connecting-head 30 is further provided with a screw hole 34 centrally on its upper end, which allows a positioning bolt 35 to be mounted thereon. The positioning bolt 35 has a through hole 36 on one end that is sized to receive central core wires of the wire being connected. The hole 36 allows the core wires to extend therethrough.

The die block 40 at least has two sets of connecting sections 41A, 41B for placing therein two sets of wires and connector bodies of different sizes and specifications. Each of the connecting sections 41A, 41B include a projection 62A, 62B having a slot 64A, 64B. A recess 66A, 66B is formed on one side of the projection 62A, 62B. The slots 64A, 64B are each sized to receive a different size wire, such as wire 72 (FIG. 8) and wire 73 (FIG. 9) for example, while the recesses 66A, 66B are each sized to receive a different connector, such as connector 82 (FIG. 8) and connector 83 (FIG. 9) for example. The projections 62A, 62B are offset from each other to provide a different distance "d" between the connecting-head 30 and the recess 66A, 66B to accommodate different size connector bodies.

The die block 40 has an opening 42 sized to receive a body 70 of fastener 43. The fastener 43 has an end portion 68 having a larger diameter than the opening 42. The fastener 43 couples to the fixing block 14 to capture the die block 40 while allowing the die block 40 to rotate. Opposite the end portion 68 is a threaded portion 75 that engages a corresponding threaded opening 15 in the fixing block 14. The body 70 includes an annular recess 74 that extends 360 degrees about the body 70. The annular slot or recess 74 is sized to receive a biasing member, such as compression spring 76. The detent member 16 engages an opening in the die block 40. Thus, during operation, the operator only needs to rotate the die block 40 to change the tool 8 for use with different connectors or wires.

Figure 5:
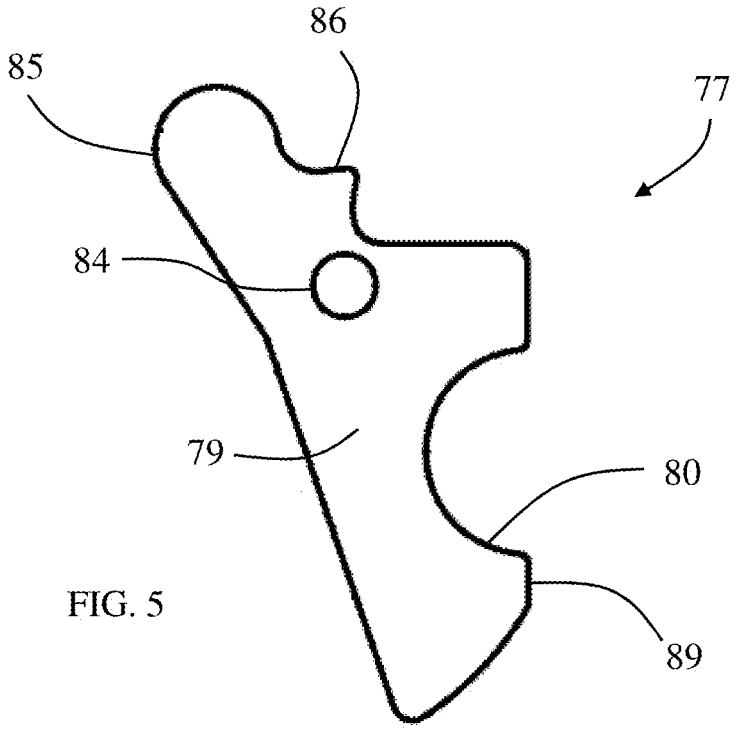
FIG. 5 is a top view of a support lever for use with the tool of FIG. 1 in accordance with an embodiment of the invention.
Figure 6:
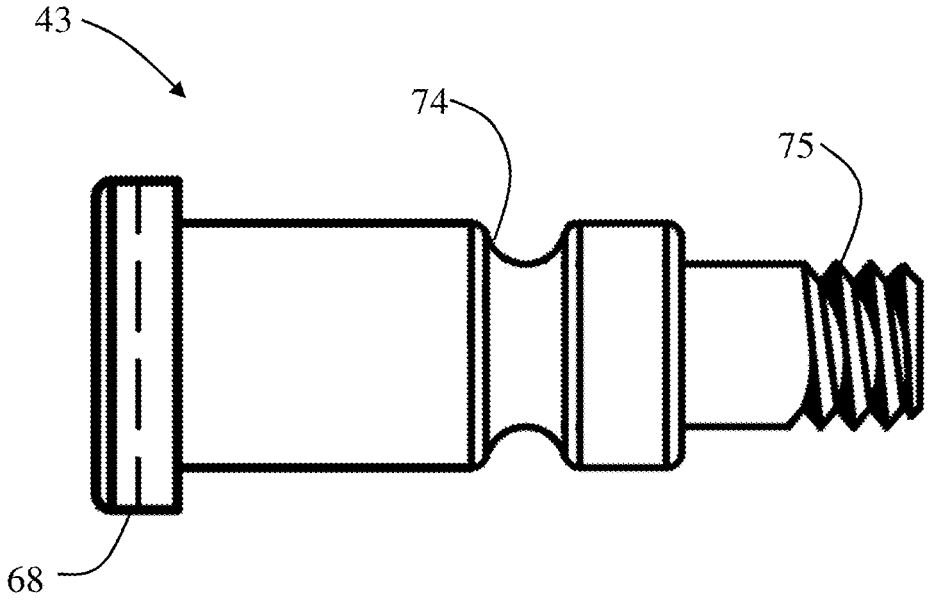
FIG. 6 is a side view of connecting bolt of FIG. 1 in accordance with an embodiment of the invention; and, FIGS. 7-9 are perspective views of a connector and a connecting-head in accordance with an embodiment of the invention.

The die block 40 further includes a pair of support arms 77, 78 that are rotationally coupled to the connecting section 41A. The support arms 77, 78 include a body portion 79 having a semi-circular opening 80 (FIG. 5). The opening 80 is sized to receive a wire. In one embodiment, the opening 80 is sized to receive one-half of a wire used with a connector such as a 6/59 compression connector for example. The body further includes an opening 84 that receives a pin 90 that pivotally couples the support arm 77 to the connecting section 41A. Extending from the body 79 is an extension 85. The extension 85 is arranged on an angle to facilitate the operator's actuation of the support arm 77 while also allowing the support arm 77 to rotate without interference. A projection 86 is arranged adjacent the body 79. The projection 86 is positioned and sized to engage the end of the spring 76.

Figure 3:
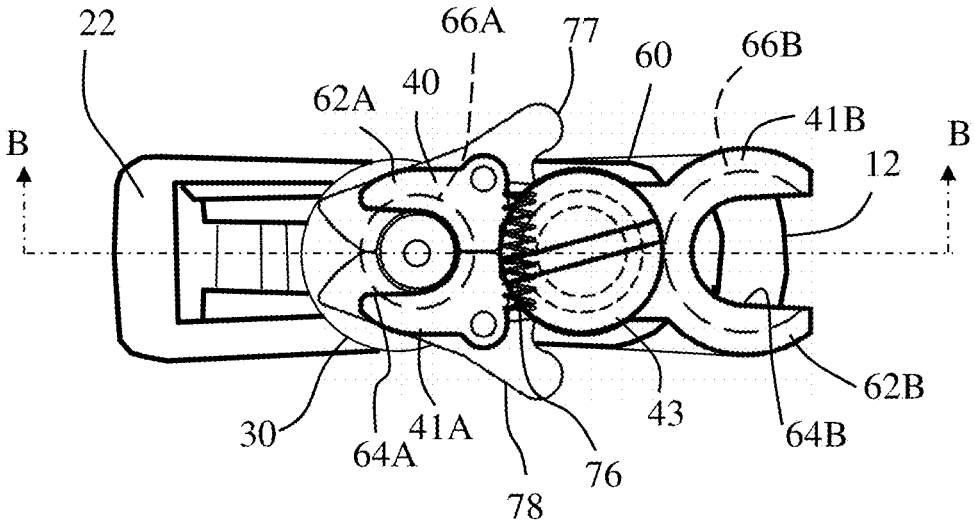
FIG. 3 is a top view of the tool of FIG. 1 in a second position.
Figure 4:
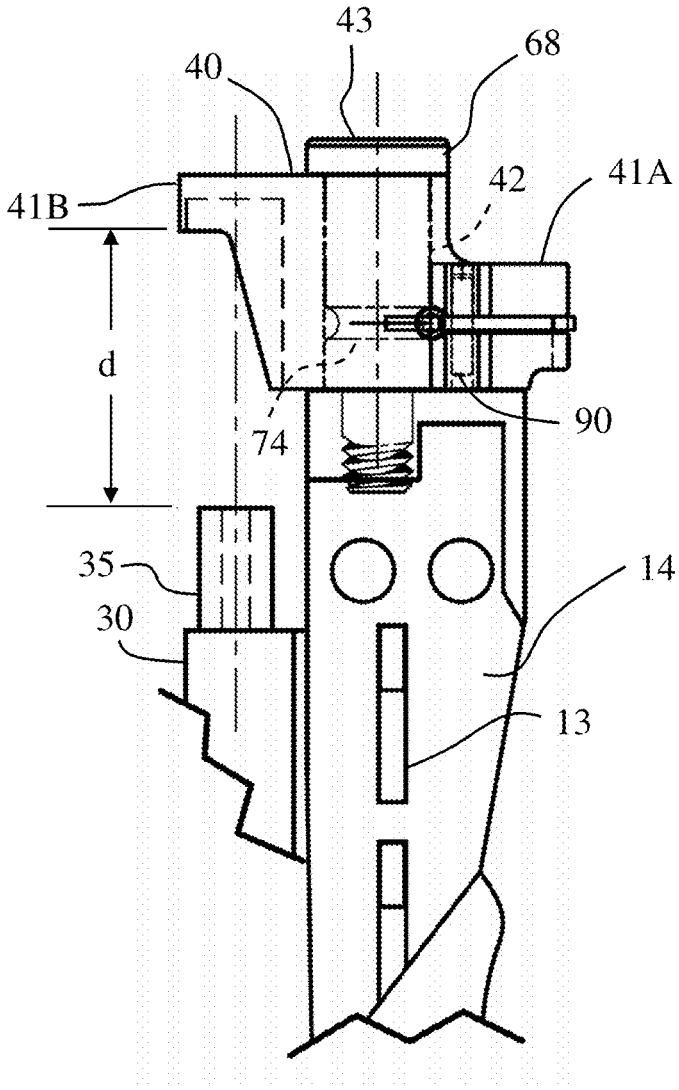
FIG. 4 is partial side view of the tool of FIG. 1.

In the exemplary embodiment, the support arm 78 is substantially identical and is arranged as a mirror image to the support arm 77. The support arms 77, 78 are movable between a first or open position (FIG. 2) and a second or closed position (FIG. 3). When in the open position, the body portions 79 define a gap 88 sized to receive a wire, such as the wire for a 6/59 compression connector for example. When in the closed position, the ends 89 contact each other such that the openings 80 cooperate to define a circular opening. This circular opening is sized to receive the outer diameter of the wire, while being smaller than the outer diameter of the end of the connector body. In this manner, the end area of the connector body is supported substantially 360 degrees about its periphery. As will be discussed in more detail below, this provides advantages in reducing or eliminating the deformation of the connector during use.

During operation, the operator first selects which connecting section 41A, 41B is appropriate for the wire and connector being coupled. For some connectors, such as 7/11 type compression connector, the connector body has a metal ring in the sleeve that resists distortion or deformation of the connector body. These types of compression connectors may use a portion of the die block such as connecting section 41B where the connector body is only supported during the coupling process by the recess 66B. With these reinforced types of connectors, the connector will not distort even though the connector is only supported along a portion of its periphery.

For other types of compression connectors, such as a 6/59 compression connector, it has been found that deformation is less likely to occur when the end of the connector body is supported 360 degrees about its periphery. For compression connectors such as these, the operator will rotate the die block 40 to position the connecting section 41A adjacent the connecting head 30. To insert the connector and wire, the operator squeezes the extensions 85 on the support arms 77, 78 causing the support arms 77, 78 to pivot and create the gap 88. The gap 88 allows the connector to be inserted with the end opposite the wire engaging the connecting head 30 and the wire being positioned in the gap 88 and the slot 64A. Once the connector and wire is positioned, the operator may release the lever arms 77, 78 which rotate under the bias of spring 76 to the closed position wherein the wire is arranged in the openings 80.

With the connector and wire inserted into the tool 8, the operator squeezes the handles 10, 20 causing the connecting-head 30 to move towards the connecting section 41A, 41B that is axially aligned with the connecting-head 30. When the connecting section 41B is aligned with the connecting-head 30, the movement of the connecting-head 30 pushes the connector against the recess 66B and the wire is coupled to the connector. When the connecting section 41A is aligned with the connecting head 30, the movement of the connecting head 30 pushes the connector against the support arms 77, 78. Since the support arms 77, 78 provide substantially 360 degrees of support to the end of the connector in contact with the support arms 77, 78, deformation or distortion of the connector is substantially reduced or eliminated.

Figure 7:
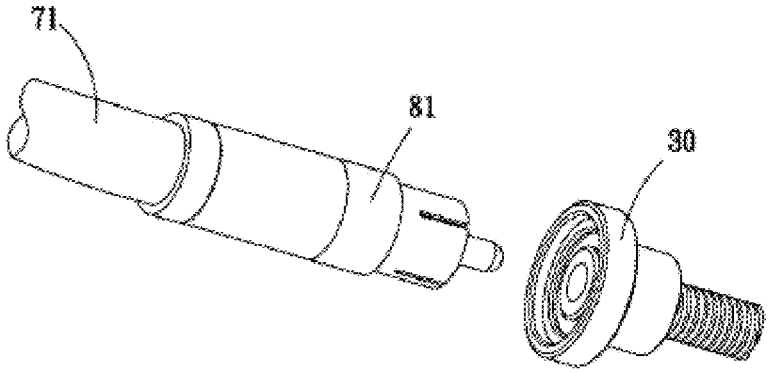
Figure 8:
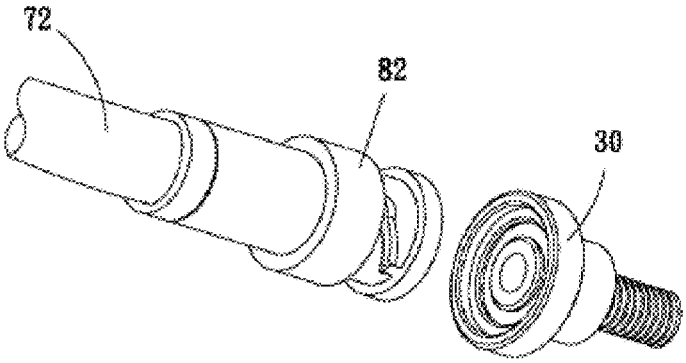
Figure 9:
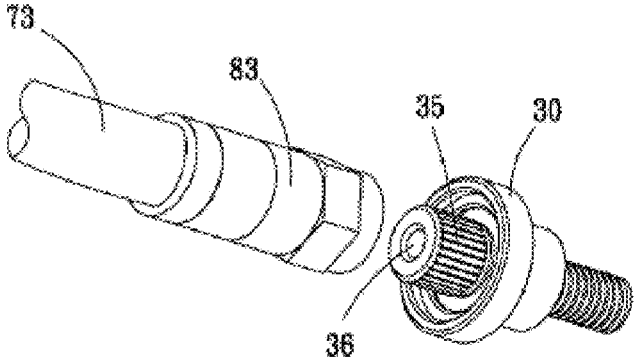

Referring to FIGS. 7-9 perspective views are shown of connecting-head 30, with wires 71, 72, 73 and connector bodies 81, 82, 83 that may be coupled using the tool in accordance with embodiments of the invention. In exemplary embodiment, connector 81 is an RCA type connector for use with sound channels for example. The connector 82 is a BNC type connector for use with cable televisions for example. The connector 83 is an F-type compression connector.

Embodiments of the invention provide advantages in allowing for the coupling of a wire to a connector using while, reducing, minimizing or eliminating distortion or deformation of the connector body. Embodiments of the invention provide still further advantages in allowing multiple types or sizes of connectors to be processed using the same tool.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A tool for coupling a connector to a wire, the tool comprising:

a first handle;

a connecting head operably coupled to the first handle, the connecting head being movable from a first position to a second position in response to the movement of the first handle;

a second handle operably coupled to the first handle;

a die block rotationally coupled to the second handle, the die block having a first connecting section and a second connecting section;

a pair of support arms pivotally coupled to the die block adjacent the first connecting section, the pair of support arms each having a body with an opening, wherein the pair of support arms are movable between an open and a closed position, the openings cooperating with each other to define a substantially circular opening when in the closed position, the circular opening sized to provide substantially 360 degrees of support to an end of the connector when the connecting head is in the second position; and, a biasing member coupled to the pair of support arms to bias the support arms towards the closed position.

2. The tool of claim 1 wherein the support arm bodies cooperate to define a gap sized to receive a wire when in the open position.

3. The tool of claim 2 wherein the die block is rotatable between a third position and a fourth position, the pair of support arms being positioned between the first connecting section and the connecting head when in the third position.

4. The tool of claim 3 wherein the die block is coupled to the second handle by a fastener, the fastener having a body portion with an annular slot, the biasing member being disposed within the annular slot.

5. The tool of claim 4 wherein the biasing member is a compression spring.

6. The tool of claim 4 wherein each of the pair of support arms has an extension extending on an angle from the body.

7. The tool of claim 6 wherein each extension has a projection positioned to engage the compression spring.

8. A tool for coupling a connector to a wire, the connector having a body, the tool comprising:

a first handle;

a mechanism having a connecting head, the mechanism moving the connecting head from a first position to a second position in response to the movement of the first handle;

a second handle operably coupled to the first handle;

a die block is operably coupled to the second handle, the die block having a first connecting section and a second connecting section;

a fastener configured to rotationally couple the die block to the second handle, the fastener having an annular slot;

a pair of support arms pivotally coupled to the die block adjacent the annular slot, the pair of support arms each having a body with an opening, wherein the pair of support arms are movable between an open and a closed position, the openings cooperating with each other to define a substantially circular opening when in the closed position; and, a biasing member disposed at least partially within the annular slot, the biasing member being coupled to the pair of support arms to bias the support arms towards the closed position.

9. The tool of claim 8 wherein the support arm bodies cooperate to define a gap sized to receive a wire when in the open position.

10. The tool of claim 9 wherein the circular opening is sized to provide substantially 360 degrees of support to an end of the connector when the connecting head is in the second position.

11. The tool of claim 1 wherein the die block is rotatable between a third position and a fourth position, the pair of support arms being positioned between the first connecting section and the connecting head when in the third position.

12. The tool of claim 11 wherein the biasing member is a compression spring.

13. The tool of claim 12 wherein each of the pair of support arms has an extension extending on an angle from the body.

* * * * *